United States Patent [19]

Closmann et al.

[11] 3,967,853

[45] July 6, 1976

[54] PRODUCING SHALE OIL FROM A CAVITY-SURROUNDED CENTRAL WELL

[75] Inventors: Philip J. Closmann; Min Jack Tham, both of Houston, Tex.

[73] Assignee: Shell Oil Company, Houston, Tex.

[22] Filed: June 5, 1975

[21] Appl. No.: 584,100

[52] U.S. Cl. ..... 299/4; 166/245; 166/271; 166/272; 299/5

[51] Int. Cl.[2] ..... E21B 43/24; E21B 43/28

[58] Field of Search ..... 166/271, 272, 303, 250, 166/252, 245, 256; 299/4, 5, 14

[56] References Cited

UNITED STATES PATENTS

| | | | |
|---|---|---|---|
| 2,561,639 | 7/1951 | Squires | 299/4 |
| 3,022,986 | 2/1962 | Brandt | 299/5 |
| 3,501,201 | 3/1970 | Closmann et al. | 299/4 |
| 3,759,574 | 9/1973 | Beard | 299/4 |
| 3,779,602 | 12/1973 | Beard et al. | 299/5 |
| 3,792,902 | 2/1974 | Towell et al. | 299/5 |
| 3,804,169 | 4/1974 | Closmann | 166/267 |
| 3,880,238 | 4/1975 | Tham et al. | 166/250 X |

*Primary Examiner*—Stephen J. Novosad

[57] ABSTRACT

In producing shale oil by circulating hot fluid into and out of void spaces within a subterranean oil shale, a plurality of cavities are formed around a central well, the cavities and the well are interconnected by leaching an areally extensive void space within a layer of water-soluble mineral, and hot fluid is circulated in through the cavities and out through the central well.

4 Claims, 4 Drawing Figures

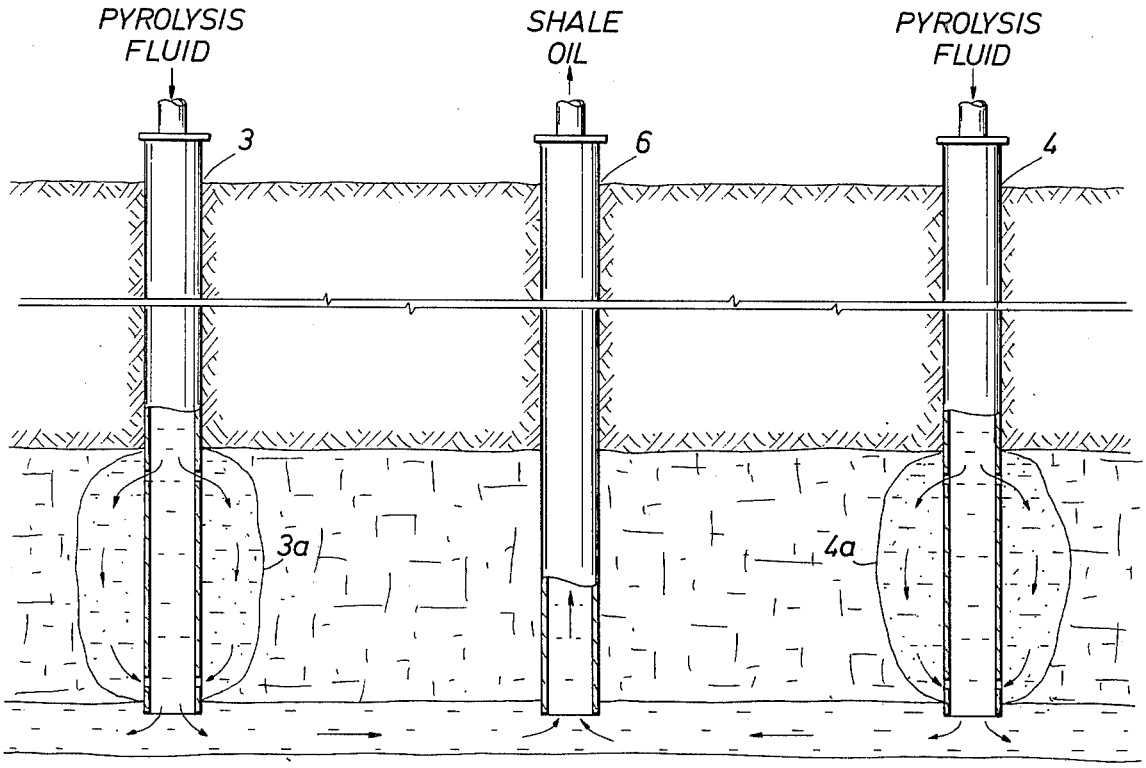
FIG. 3
FIG. 4
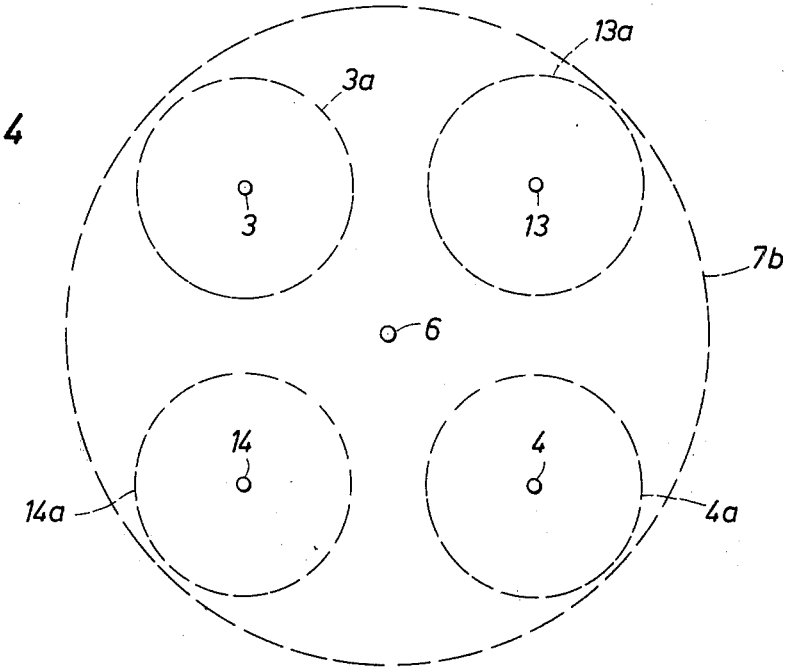

PRODUCING SHALE OIL FROM A CAVITY-SURROUNDED CENTRAL WELL

BACKGROUND OF THE INVENTION

The invention relates to producing shale oil and other mineral from subterranean deposits of oil shale.

Numerous subterranean oil shales are mixed with water-soluble minerals. Such shales comprise substantially impermeable, kerogen-containing, earth formations from which shale oil can be produced by a hot fluid-induced pyrolysis or thermal conversion of the organic solids to fluids. A series of patents typified by the T. N. Beard, A. M. Papadopoulos and R. C. Ueber U.S. Pat. Nos. 3,739,851; 3,741,306; 3,753,594; 3,759,328; 3,759,574 describe procedures for utilizing the water-soluble minerals in such shales to form rubble-containing caverns. In the caverns the oil shale is exposed to a circulating hot aqueous fluid that converts the kerogen to shale oil while dissolving enough mineral to expand the cavern and expose additional oil shale. In such a process, the heat transfer is aided by injecting the hot fluid into an upper portion and withdrawing fluid from a lower portion of the cavern.

However, as described in the P. J. Closmann and G. O. Suman U.S. Pat. Nos. 3,804,169 and 3,804,172 such prior cavern-utilizing processes are subject to a tendency for the flow paths to become plugged. The hot aqueous fluid flowing down along the walls of the cavern disaggregates portions of the shale oil into particles having sizes ranging from a few microns to several feet in diameter. The particles tend to slump or flow as a turbidity current down the walls of the cavern and pile up around the fluid withdrawal point near the bottom of the cavern. In the U.S. Pat. No. 3,804,169, a pattern of fracture-interconnected caverns and wells are arranged so that fluid injected near the top of one well is produced through a plurality of surrounding wells with the flow rates being too low to carry the solids to the production well. In the U.S. Pat. No. 3,804,172, the lower portion of such a cavern is packed with a mass of large rigid solid particles, so that the solids in the slumping turbidity currents are spread over large surface areas while the fluids are flowing through the relatively large openings that exist between the particles.

SUMMARY OF THE INVENTION

This invention relates to producing shale oil from a subterranean oil shale formation which contains or is contiguous with an areally extensive layer of water-soluble mineral. A plurality of cavities are formed in horizontally spaced locations surrounding a central well within the subterranean oil shale formation. Portions of the areally extensive layer of water-soluble mineral are solution mined to form a generally horizontal void that interconnects the cavities and the central well. And, shale oil is recovered by circulating hot fluid into the cavities, through the void connecting them with the central well, and out through the central well.

DESCRIPTION OF THE DRAWING

FIGS. 1 to 3 are schematic illustrations of portions of a subterranean oil shale formation in which the present process is being employed.

FIG. 4 is a plan view of a well pattern suitable for use in the present invention.

DESCRIPTION OF THE INVENTION

Figure 1:
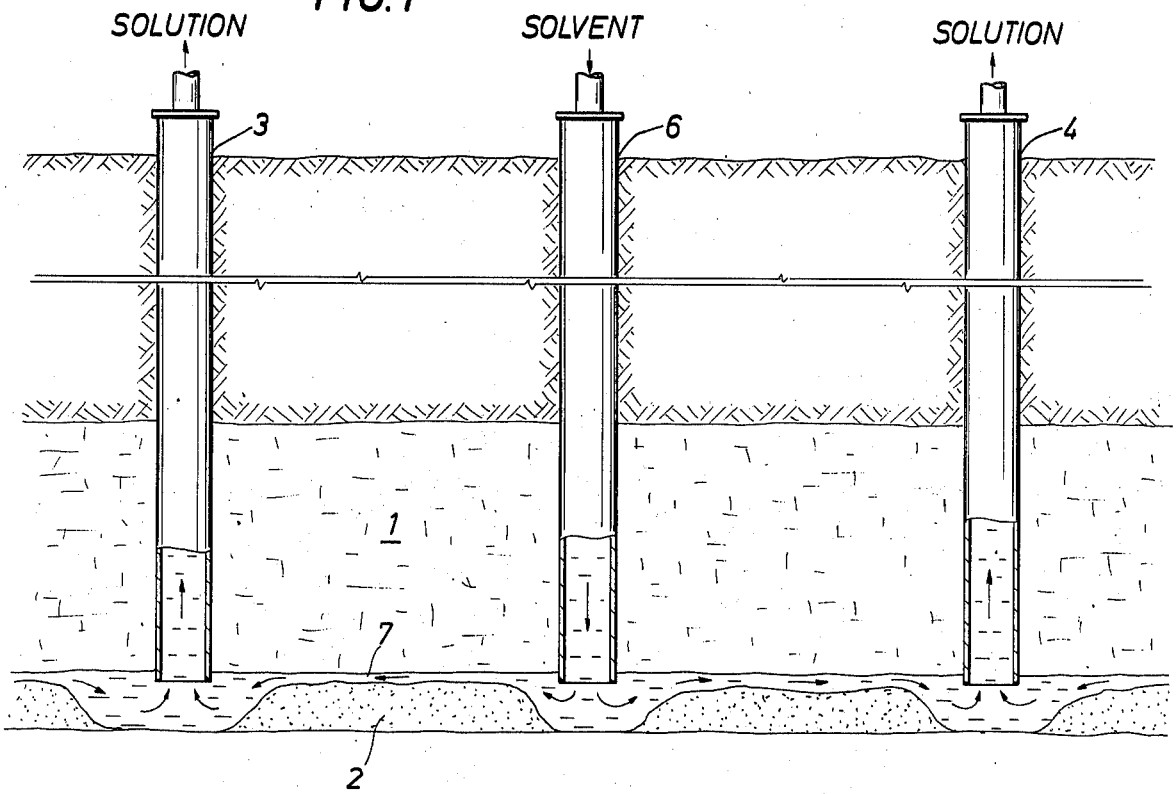

The M. J. Tham, P. J. Clossman U.S. Pat. No. 3,880,238 describes a process for producing shale oil by circulating hot fluid into and out of a cavity in a subterranean oil shale formation in which the tendency for the fluid flow path to become plugged is reduced by injecting both a hot solvent fluid and a hot nonsolvent gas at rates adjusted to reduce the rate of disaggregating the oil shale into fine solid particles and to keep the cavity substantially free of liquid.

In the present process a plurality of cavities are interconnected with each other and a central well. The cavities are treated concurrently to produce shale oil from an areally extensive portion of the oil shale formation while maximizing the control of the fluid circulation and providing a relatively complete sweep of the formation. Where desirable, the rate of oil shale disaggregation can be controlled in the manner described in the U.S. Pat. No. 3,880,238 to avoid the plugging of the flow path. The composition of the circulated fluid can be adjusted to provide proportions of hot solvent fluid and hot non-solvent gas that maintain a selected rate of expansion of the cavity walls without causing an unduly rapid disaggregation of oil shale to fine solids. In such a fluid the hot solvent may consist essentially of steam while the hot non-solvent gas consists essentially of the products of an underground combustion.

As used herein "oil shale" refers to a substantially impermeable aggregation of inorganic solids and a predominately hydrocarbon-solvent-insoluble organic-solid material known as "kerogen". "Bitumen" refers to the hydrocarbon-solvent-soluble organic material that may be initially present in an oil shale or may be formed by a thermal conversion or pyrolysis of kerogen. "Shale oil" refers to gaseous and/or liquid hydrocarbon materials (which may contain trace amounts of nitrogen, sulfur, oxygen, or the like) that can be obtained by distilling or pyrolyzing or extracting organic materials from an oil shale. "Water-soluble inorganic mineral" refers to halites or carbonates, such as the alkali metal chloride bicarbonates or carbonates, which compounds or minerals exhibit a significant solubility (e.g., at least about 10 grams per 100 grams of solvent) in generally neutral aqueous liquids (e.g., those having a pH of from about 5 to 8) and/or heat-sensitive compounds or minerals, such as nahcolite, dawsonite, trona, or the like, which are naturally water-soluble or are thermally converted at relatively mild temperatures (e.g., 500° to 700°F) to materials which are water soluble. The term "water-soluble-mineral-containing subterranean oil shale" refers to an oil shale that contains or is mixed with at least one water-soluble inorganic mineral, in the form of lenses, layers, nodules, finely-divided dispersed particles, or the like. A "cavern" or "cavity" (within an oil shale formation) refers to a relatively solids-free opening or void in which the solids content is less than about 60% (preferably less than about 50%) and substantially all of the solids are fluid-surrounded pieces which are substantially free of lithostatic pressure, due to the weight of the overlying rocks.

In the present process the cavities can readily be formed by currently available means. A small cavity is formed by drilling a borehole. It can be enlarged by under-reaming, solution-mining, hydraulic or explosive fracturing, or the like operations. Where desirable, acids and/or viscous fluids can be utilized to dissolve and/or entrain solids to increase the volume of solid-free space within a cavity.

The solution-mining of water-soluble minerals by circulating hot aqueous fluid through an initially relatively small cavity (such as an under-reamed portion of a borehole) is a particularly preferred procedure for concurrently expanding the volume of a cavity and leaching the water-soluble minerals to form a permeable oil shale rubble within the cavity. The T. N. Beard — P. vanMeurs U.S. Pat. No. 3,779,602 describes a particularly suitable process of solution-mining bicarbonate minerals by circulating hot water at a pressure that is optimized for enhancing the growth of a permeable rubble-containing cavity. The L. H. Towell — J. R. Brew U.S. Pat. No. 3,792,902 describes such a solution-mining process in which plugging due to mineral precipitation is minimized by injecting an aqueous diluent into downhole portions of the outflowing fluid. In general, the solution-mining fluid can be substantially any aqueous liquid (which is preferably slightly acidic or neutral) that tends to dissolve the water-soluble mineral without damaging the well conduits. Such a fluid is preferably circulated at a temperature, of from about 200°F to 400°F, exceeding the temperature of the adjacent portions of the subterranean oil shale formation.

Where the cavity in the oil shale formation is initially a substantially vertical section of a well borehole, the leaching fluid is advantageously injected into the cavity at a point near the bottom, with the mineral-laden solution being withdrawn from a point near the top. The points of injection and withdrawal can be reversed and the flow rate can be cyclically changed, both in direction and rate. The leaching is preferably continued to provide a cavity that contains a permeable oil shale rubble and has a suitable volume. As the leaching fluid contacts the oil shale in and along the walls of the cavity, soluble materials are dissolved from the contacted portions. This imparts permeability. Where the distribution of the water-soluble mineral is non-uniform, the leaching out of streaks or layers may cause the collapse of chunks of oil shale that become more permeable as the leaching continues. Along the walls, the rate of leaching tends to decrease with increases in the size of the cavity.

In general, the mineral-leaching should be continued until the cavity radius is on the order of 40 to 50 feet or more, preferably at least 100 feet. The cavity vertical height should approximate the thickness of the oil shale deposits and should be at least about 200 feet, and preferably at least about 500 feet. The average permeability of the pieces of leached oil shale formation within the cavity and along the innermost portions of the cavity walls should be at least about 1 and preferably 10 or more darcies (1,000 to 10,000 or more millidarcies).

The minerals dissolved during the leaching operation can, of course, be recovered (by means known to those skilled in the art) and can provide valuable by-products to the recovery of shale oil. In general, during the leaching process, some (but relatively small amounts of) shale oil is entrained with and can be recovered from the fluid being circulated to effect the leaching operation.

A hot solvent-fluid suitable for use in the present process is one which is heated to a temperature of about 500° to 700°F and, at that temperature, has a significant miscibility with at least one of the organic or inorganic solid or liquid components or pyrolysis products of a water-soluble-mineral-containing oil shale. Such fluids preferably contain, or consist essentially of, steam at a temperature and pressure causing condensation within the cavern. Such fluids may also include or comprise hydrocarbons such as benzene, toluene, shale oil hydrocarbons, oil-soluble gases such as carbon dioxide, mixtures of such fluids, or the like.

A hot non-solvent-gas suitable for use in accordance with this invention can comprise substantially any gas which is heated to a temperature of at least about 500°F and, at that temperature, has a relatively insignificant miscibility with any of the organic or inorganic solid or liquid components or pyrolysis products of a water-soluble-mineral-containing oil shale. Such a gas preferably has a solubility of less than about 1 part per hundred in such solid or liquid components or pyrolysis products. Suitable non-solvent-gases include nitrogen, natural gas, combustion gases, methane (substantially free of higher hydrocarbons), mixtures of such gases, and the like. Particularly where steam is used as the hot solvent-fluid, the hot non-solvent-gas can be injected at temperatures higher than about 700°F, for example, to enhance the rate of revaporizing the steam condensate and the drying out of the cavern.

In a preferred embodiment of the present process, the borehole of the central well (through which the shale oil-containing hot fluid is produced) is cased or lined in a manner that restricts the rubbling or disaggregating of the earth formations that form the wall of the borehole. This can be effected by means of methods or devices known to those skilled in the art. For example one or more strings of casings or liners can be run in and cemented, the borehole walls can be heat-treated to carbonize the organic components, the inorganic components can be thermally glazed or coated with materials that are resistant to the temperature and solvent effects of the outflowing fluid, etc.

FIG. 1 shows a portion of an oil shale formation 1 which contains or is contiguous with a water-soluble layer 2, such as the Greeno nahcolite layer that is commonly encountered in the lower portion of oil shale formations in Colorado. Wells 3, 4 and 6 are drilled into the soluble layer 2. An open channel 7 (comprising an areally extensive void in the space occupied by layer 2) is formed by solution-mining portions of the soluble mineral so that the channel interconnects the wells. The channel can be formed by means of known procedures and materials.

For example, near well portions can be leached out by initially extending tubing strings (not shown) into each of the wells so that hot aqueous fluids can be circulated to leach out portions of the soluble mineral around each well. The fluids in the leached portions can then be pressurized to form generally horizontal fractures along the soluble mineral boundary and extend the fractures between the wells. A solution of the soluble mineral-solvent can then be circulated in through well 6 and out through wells 3 and 4, as shown by the arrows in FIG. 1, to form the well-interconnecting channel 7.

Figure 2:
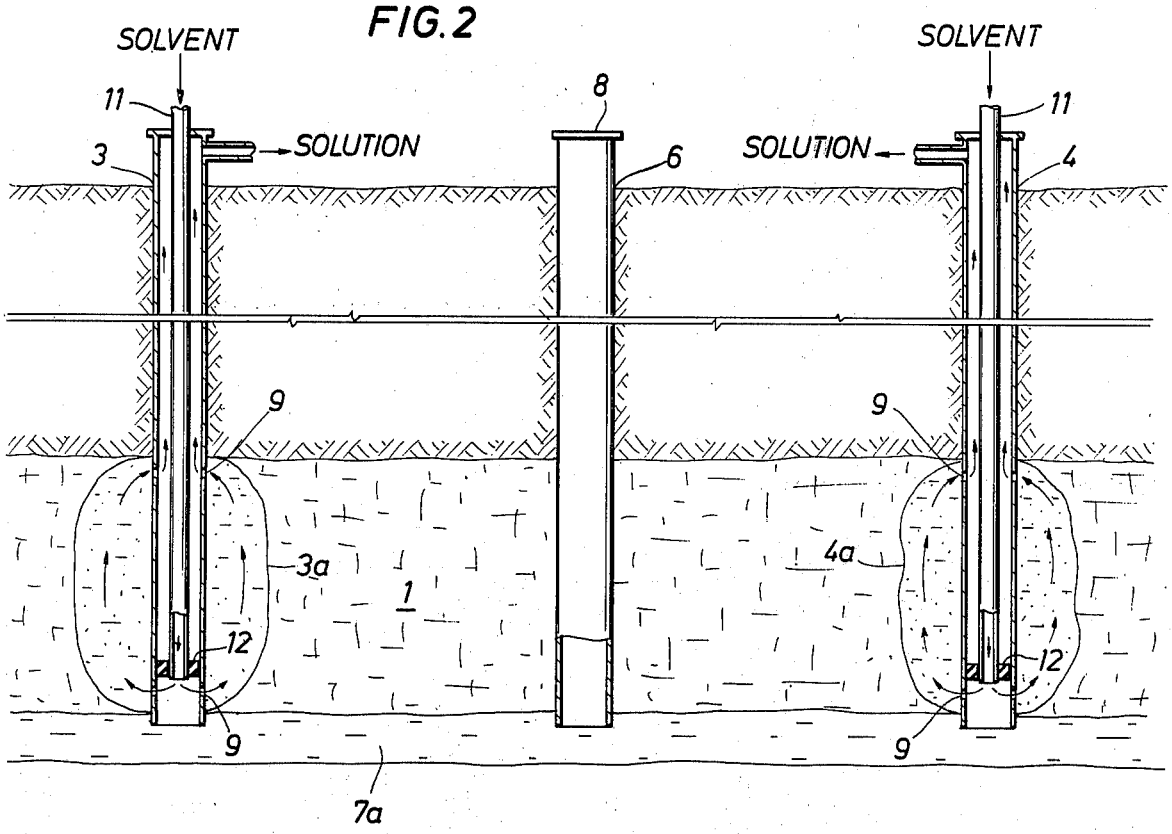

As shown in FIG. 2 the well-interconnecting channel 7 can be leached out to form a substantially solids-free areally extensive void space **7*a*** that interconnects the wells. Such a void space can conduct a relatively large volume of fluid without requiring a high velocity of flow.

The boreholes of wells 3 and 4 can be readily converted to cavities within the oil shale formation 1. During this operation the well 6 can be closed in, as indicated by the cap 8, so that the fluid in well 6 and the passageway 7*a* remain substantially static. In forming the cavities, the casings in the wells 3 and 4 can be penetrated by perforations 9. Such wells can be equipped with tubing strings 11 and packers 12, so that solvents and solutions can be circulated along the walls of the boreholes as shown by the arrows. Such circulations of hot aqueous solvents mine or leach the water-soluble minerals present in the oil shale formation. In effect, this expands the walls of the boreholes into cavities of increasing diameters, as indicated by the dashed lines and lines 3*a* and 4*a*.

FIG. 3 shows a later stage of the present process. Hot pyrolysis fluid is circulated in through the cavities around wells 3 and 4 while shale oil-containing fluid is circulated out through the central well 6. As known to those skilled in the art, the tubings and packers 11 and 12 can be removed (as shown) or retained within the wells, with certain advantages and disadvantages accompanying either procedure. In general, the injected fluid is (a) preferably at least predominately a hot, non-solvent gas that pyrolyzes the kerogen in the rubble in and along the walls of the cavities 3*a* and 4*a* into which the walls of the boreholes of wells 3 and 4 have been expanded, and (b) is injected at a rate such that the wall-expansion continues without an undue amount of disaggregation of the oil shale into fines.

FIG. 4 shows an essentially five-spot pattern of cavities and wells for use in the present process. The wells 3, 4 and 6 are supplemented by wells 13 and 14. All of the wells are interconnected by the areally extensive passageway 7, which has been extended beyond the cavities, as indicated by the broken line 7*b*. The cavity walls 3*a*, 4*a*, 13*a* and 14*a* can be expanded until they extend substantially as close as desired to each other. Although the process can be conducted with one or more pairs of the cavities interconnected, it is generally preferable to leave sufficient "pillars" of untreated oil shale to prevent undue subsidence of the oil shale and the overlying earth formations. Multiples of such patterns of cavity-surrounded central wells, having ratios of cavities to central wells of at least one, may be used in the present process.

What is claimed is:

1. A process for producing shale oil from a subterranean oil shale which contains or is contiguous with an areally extensive layer of water-soluble mineral, which process comprises:

forming a plurality of cavities in horizontally-spaced locations surrounding a central well;

casing or lining the borehole of the central well in a manner that restricts the rubbling or disaggregating of earth formations that form the wall of the borehole;

solution-mining portions of the areally extensive layer of water-soluble mineral to form a generally horizontal, substantially solids-free passageway that interconnects the cavities and the central well; and circulating hot fluid into the cavities, through the passageway interconnecting the cavities with the central well, and out through the central well to recover shale oil.

2. The process of claim 1 in which multiple patterns of cavity-surrounded central wells are formed with the ratio of cavities to central wells being at least one.

3. The process of claim 1 in which the hot fluid composition is adjusted to provide proportions of hot solvent fluid and hot non-solvent gas that maintain a selected rate of expansion of the cavity walls without causing an unduly rapid rate of disaggregation of oil shale to fine solids.

4. The process of claim 3 in which the hot solvent fluid consists essentially of steam and the hot non-solvent gas consists essentially of the products of an underground combustion.

* * * * *